US006534230B1

(12) United States Patent
Blair et al.

(10) Patent No.: US 6,534,230 B1
(45) Date of Patent: Mar. 18, 2003

(54) TONER FORMULATIONS

(75) Inventors: Bryan Michael Blair, Lexington, KY (US); Michael Thomas Moore, Longmont, CO (US); Michelle Kathryn Morris, Lexington, KY (US); John Melvin Olson, Boulder, CO (US); Jodi Lynne Walsh, Berthod, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/966,190

(22) Filed: Sep. 28, 2001

(51) Int. Cl.[7] ..... G03G 9/097

(52) U.S. Cl. ..... 430/108.24; 430/108.1; 430/108.6; 430/108.7; 430/108.8; 430/109.4

(58) Field of Search ..... 430/108.6, 108.7, 430/108.2, 108.24, 108.1, 108.8, 109.4

(56) References Cited

U.S. PATENT DOCUMENTS

| | | | | |
|---|---|---|---|---|
| 3,565,654 A | * | 2/1971 | Story | 430/108.2 |
| 4,623,605 A | | 11/1986 | Kato et al. | |
| 4,647,522 A | | 3/1987 | Lu | |
| 4,652,509 A | | 3/1987 | Shirose et al. | |
| 5,212,037 A | | 5/1993 | Julien et al. | |
| 5,272,040 A | | 12/1993 | Nakasawa et al. | |
| 5,429,902 A | | 7/1995 | Saito et al. | |
| 5,504,559 A | | 4/1996 | Ojima et al. | |
| 5,698,357 A | | 12/1997 | Inoue et al. | |
| 5,705,305 A | | 1/1998 | Ohta et al. | |
| 5,747,211 A | | 5/1998 | Hagi et al. | |
| 5,759,731 A | | 6/1998 | Hagi et al. | |
| 5,776,646 A | | 7/1998 | Hagi et al. | |
| 5,811,214 A | | 9/1998 | Osterhoudt et al. | |
| 5,827,632 A | | 10/1998 | Inaba et al. | |
| 5,837,413 A | | 11/1998 | Yada et al. | |
| 5,840,458 A | | 11/1998 | Kido et al. | |
| 5,853,938 A | | 12/1998 | Nakazawa et al. | |
| 5,863,692 A | | 1/1999 | Nakamura et al. | |
| 5,905,011 A | | 5/1999 | Kurose et al. | |
| 5,922,500 A | | 7/1999 | Iida et al. | |
| 5,998,079 A | | 12/1999 | Thompson et al. | |
| 6,077,639 A | * | 6/2000 | Semura et al. | 430/109.4 |

FOREIGN PATENT DOCUMENTS

JP 06-332232 * 12/1994

OTHER PUBLICATIONS

Patent Abstracts of Japan Abstract Describing JP 06–332232 (Pub. Dec. 2, 1994).*

Applicants's Translation of Claim 1 of JP 06–332232 (Pub Dec. 2, 1994).*

Japanese Patent Office Machine–Assisted Translation of JP 06–332232 (Pub 12/94).*

Derwent Machine Assisted English– Language of JP 6–332232 (Pub. 12/94).*

* cited by examiner

*Primary Examiner*—Janis L. Dote
(74) *Attorney, Agent, or Firm*—John A. Brady

(57) ABSTRACT

A dry, powder electrostatic toner having polyester resin as a binder, pigment as a colorant, charge control ingredients polyethylene wax as a release agent, and extra particulate elements to improve flow and to scrub the doctor blade, one extra particular element is hydrophilic rutile acicular titanium oxide with aluminum oxide surface treatment, two silicas are blended within the bulk of the toner, one of BET surface area of about 30 $m^2/g$ and one of BET surface area of about 380 $m^2/gn$; and an organoboron complex negative exchange control agent is blended with a quaternary ammonium salt of an aluminosilicate compound negative charge control agent. Improved functioning as a toner is realized.

9 Claims, No Drawings

TONER FORMULATIONS

TECHNICAL FIELD

This invention relates to dry, powder electrophotographic toners suitable for multicolor and single color or black imaging.

BACKGROUND OF THE INVENTION

Toners suitable for multicolor imaging avoid employing dark ingredients, as dark masks the intended color. Silicon carbide is dark and cannot be used, even in the small amounts it is typically used, as ingredient on the surface of toner particle (often termed an extra particulate additive or EPA).

The function of the silicon carbide in prior toners was as an abrasive to scrub the contact surface of the doctor blade. Instead of silicon carbide, this invention employs a material believed entirely novel as an EPA. The material is rutile acicular titanium oxide with aluminum oxide surface treatment.

The embodiment described in detail in this application is operative at relatively low fusing temperatures so as to facilitate multicolor imaging on transparencies. Consistent with such low temperatures, the wax component of the toner, which is for release of toner from the fuser, can be of relatively low molecular weight (500 Mn in the embodiment). Additionally, this embodiment contains two amorphous silica particles in the bulk. The first particle, having a BET specific surface area of about 3±15 $m^2$/gm, is rendered hydrophobic. The second particle, having a BET specific surface area of about 380 $m^2$/gm is not surface treated. The incorporation of these particles in the bulk of the toner allows the toner to survive temperature and humidity extremes during storage and shipping without caking or blocking and the associated print quality flaws. This is desirable as toners, especially low melt toners, must be robust to shipping and storage conditions in order to be attractive to a world-wide market.

The embodiment of this application can employ a mixture of charge control agents, specifically an organoboron complex negative charge control agent and a quaternary ammonium salt of an aluminosilicate negative charge control agent; the combination providing consistent flow of the toner having branched polyester resin as the binder. This consistency of toner flow is both throughout the life of the toner and with toners of different colors, independent of printing environment (temperature and humidity). This provides multilayer uniformity for color applications in which toners having subtractive colors are layered over each other.

DISCLOSURE OF THE INVENTION

In a generally conventional, dry, particulate electrostatic toner having polyester resin as a binder, pigment as a colorant, charge control ingredients, wax as a release agent, and extra particulate additives (EPAs) to improve flow and to scrub contacting elements such as the doctor blade: 1) one EPA is hydrophilic rutile acicular titanium oxide with aluminum oxide surface treatment; 2) two silicas are blended within the bulk of the toner one of low surface area and one of high surface area; and 3) the charge control element is a blend of an organoboron complex negative charge control agent and a quaternary ammonium salt of an aluminosilicate compound.

The acicular titanium oxide provides a new advantage of more reliable toner flow (eliminates toner "starving"), and this advantage, as well as the scrubbing function, is similarly realized using the acicular titanium oxide with a black toner having carbon black or magnetite or both as the pigment. Similarly, similar functioning for the acicular titanium oxide has been found with toners which contain neither the foregoing dual silicas nor the foregoing charge control agents.

Similarly, the inclusion of dual, blended-in silicas is believed to be a function of the silica size and surface treatment and therefore to be applicable to a wide range of toners.

Finally the blend of charge control agents is believed to exhibit synergistic interaction with a polyester binder not dependent on the other elements to provide consistent toner flow. Such efficacy has been demonstrated with the weight ratio of the organoboron complex to the aluminosilicate being from 2 to 1 to 1 to 2.

DESCRIPTION OF THE PREFERRED EMBODIMENTS

The ingredients of the following detailed embodiment are all solids which are readily blended mechanically, then pulverized into a powder and then classified.

A formula for a cyan toner in accordance with this invention is as follows.

| Material | Function | % by Weight |
|---|---|---|
| 1. Branched Polyester Resin | Binder | 83.125 |
| 2. Linear Polyester Resin | Binder | 7.225 |
| 3. Cyan Pigment | Colorant | 2.15 |
| 4. Polyethylene Wax (about 500 Mn) | Release Agent | 3 |
| 5. Organoboron Complex | Charge Control Agent | 0.5 |
| 6. Quaternary Ammonium Salt of an Aluminosilicate Compound | Charge Control Agent | 1.0 |
| 7. Amorphous Hydrophobic Silica | Toner Characteristic Modifier | 2.0 |
| 8. Amorphous Silica | Toner Characteristic Modifier | 1 |

The foregoing ingredients were thoroughly blended by melt mixing, then pulverized and classified by size to form a power. This forms no part of this invention as entirely standard methods may be used.

The following three elements are then applied to the powder by adding the elements and then blending.

| | | |
|---|---|---|
| 9. Amorphous Hydrophobic Silica | Flow Agent | 0.7 |
| 10. Amorphous Hydrophobic Silica | Flow Agent | 0.2 |
| 11. Acicular Titanium Oxide | Scrub and Starvation Reduction | 0.4 |

The materials are further described as follows (like numbers correspond):

1. Branched polyester resin: is TUFTONE NE-701 of Kao Corp.; CAS No. None, proprietary.
2. Linear polyester resin: is DIACRON ER-561 of Mistubishi Rayon, a bisphenol A-type polyester of a higher Tg (glass transition temperature) than the NE-701; CAS No. 148556-68.7
3. Cyan pigment: is HOSTACOPY BG C 106 of Clariant (PB 15:3): 40% by weight of the linear polyester resin ER-561 (above); CAS No. 147-14-8 (pigmnent) and 148556-68-7 (resin).
4. Polyethylene wax 500 Mn: is POLYWAX 500 of Baker-Petrolite; CAS No. 10 9002-88-4.

5. Organoboron complex: is LR-147 of Japan Carlit; CAS No. 114803-11-1.
6. Quaternary ammonium salt of an aluminosilicate compound: is COPYCHARGE N4P of Clariant; CAS No. None, proprietary.
7. Amorphous hydrophobic silica: is AEROSIL RY-50 of Nippon Aerosil; BET specific surface area of about 30±15 $m^2/g$; CAS No. 67762-90-7.
8. Amorphous silica: is AEROSIL 380 of Degussa-Huls; BET specific surface area of about 380 $m^2/gm$; CAS No. 112945-52-5 and 7631-86-9.
9. Amorphous hydrophobic silica: is AEROSIL R 812 of Degussa-Huls; BET specific surface area of about 260 $m^2/g$; CAS No. 68909-20-6.
10. Amorphous hydrophobic silica: is AEROSIL NY50 of Nippon Aerosil; BET specific surface area of about 30±15 $m^2/g$; CAS No. 67762-90-7.
11. Acicular titanium oxide: is FTL110 of Ishihara Sangyo Kaisha, Ltd.; hydrophilic rutile acicular titanium oxide with aluminum oxide surface treatment; BET surface area 10–20 $m^2/g$; 130–170 nm primary particle; 6–8 pH; CAS No. 114803-11-1.

This toner is normally applied to a photoconductive drum carrying an electrostatic image by contact with a developer roller having a surface layer of the toner. As is conventional, the toner is applied to the developer roller and passes in contact with a doctor blade before reaching the photoconductive drum.

The titanium oxide needles of this toner are effective in scrubbing toner from the doctor blade so that it can continue to function well. A similar function has been achieved in the past by silicon carbide EPA, but silicon carbide is too dark to be used for colors (other than black). Moreover, the titanium needles suppress toner starvation. The titanium needles are presumably effective at enhancing toner flow under pressure to avoid toner starving, a function not observed with the silicon carbide. The exact mechanism of starvation suppression is not known. (The starvation control has been demonstrated by experimental formulas, but not specifically for the foregoing detailed embodiment.)

FTL110 acicular titania has shown itself to be a replacement for silicon carbide on the color toners. Toners which lack the acicular titania, show unacceptable starve. No other materials, including other titanias, have proven sufficient as an EPA on polyester color toners. The FTL110 acicular titania has shown itself to be effective on multiple types of polyester resins from a variety of vendors. The use of this acicular titania does not appear to be sensitive to the choice of charge control agent, filler, color (pigments including CMYK), or wax as it has functioned as a silicon carbide replacement and starvation suppressant on multiple developmental generations of the color toner which differ from one another in these formula ingredients. Other EPAs are employed to optimize the charge and flow of the toner as is appropriate for the specific development system as the FTL110 acicular titania has not shown any efficacy as charge or powder flow agent. It is not necessary for the titania to fully adhere to the toner surface to be effective.

The two silica in the toner bulk, one hydrophobic with low specific BET and one untreated with high specific BET, function to permit the toner to survive temperature and humidity extremes during storage and shipping without caking or blocking.

Additionally, the two charge control elements have been observed to function together to provide consistency of toner flow, both throughout the life of the toner and with toners of different colors. (This has been demonstrated by experimental formulas, but not specifically for the foregoing detailed embodiment.)

Many alternative ingredients may be employed for those listed. Aspects as specifically described in the foregoing are believed broadly novel. The foregoing detailed formula should be considered illustrative of other toner formulations having different pigments. Specifically, in addition to the foregoing cyan toner, a closely similar toner having magenta pigment and a closely similar toner having yellow pigment are employed as well as a similar black toner. The cyan, magenta and yellow pigments are subtractive and the toners are applied over one another to form a range of colors, as is conventional.

What is claimed is:

1. A dry, powder electrostatic toner having as an extraparticulate coating particles of hydrophilic rutile acicular titanium oxide with aluminum oxide surface treatment.

2. The toner as in claim 1 also comprising hydrophobic silica as an extraparticulate coating.

3. The toner as in claim 2 in which said toner has a binder resin of polyester.

4. The toner as in claim 1 in which said toner has a binder resin of polyester.

5. A dry powder electrostatic toner having a branched polyester resin binder, a wax release agent in said toner, and two particulate silicas blended into said toner, one of said two silicas have low BET specific surface area and being hydrophobic, the other of said two silicas being untreated and having high BET specific surface area.

6. The toner as in claim 5 in which said wax is polyethylene of Mn of about 500.

7. The toner as in claim 6 in which said polyethylene is of Mn of 500.

8. A dry, powder electrostatic toner having a branched polyester resin binder and an organoboron complex as a negative charge control agent and a quaternary ammonium salt of an aluminosilicate as a negative charge control agent.

9. The toner as in claim 8 in which said organoboron complex is in an amount by weight to the weight of said quaternary ammonium salt of an aluminosilicate compound of from 2 to 1 to 1 to 2.

* * * * *